US005247996A

United States Patent [19]

Milberger

[11] Patent Number: 5,247,996

[45] Date of Patent: Sep. 28, 1993

[54] SELF PRELOADING CONNECTION FOR A SUBSEA WELL ASSEMBLY

[75] Inventor: Lionel J. Milberger, Houston, Tex.

[73] Assignee: ABB Vetco Gray Inc., Houston, Tex.

[21] Appl. No.: 792,980

[22] Filed: Nov. 15, 1991

[51] Int. Cl.[5] ..... E21B 33/035

[52] U.S. Cl. ..... 166/348; 166/368; 285/18; 285/141

[58] Field of Search ..... 166/348, 359, 214, 208, 166/368; 285/18, 39, 141, 142, 143, 321

[56] References Cited

U.S. PATENT DOCUMENTS

| | | | |
|---|---|---|---|
| 3,521,909 | 7/1970 | Brown | 285/141 X |
| 3,986,729 | 10/1976 | Taylor | 285/18 |
| 4,093,281 | 6/1978 | Jansen, Jr. | 285/39 |
| 4,402,533 | 9/1983 | Ortloff | 285/18 |
| 4,593,944 | 6/1986 | Milberger | 285/321 |
| 4,607,865 | 8/1986 | Hughes | 285/18 |
| 4,653,778 | 3/1987 | Alandy | 285/18 |
| 4,697,828 | 10/1987 | Chou | 285/18 |
| 4,751,968 | 6/1988 | Ames et al. | 166/368 |
| 4,902,044 | 2/1990 | Williams et al. | 285/18 |
| 4,903,992 | 2/1990 | Jennings et al. | 285/141 X |
| 5,029,647 | 7/1991 | Milberger et al. | 166/367 |

FOREIGN PATENT DOCUMENTS

| | | |
|---|---|---|
| 208388 | 1/1987 | European Pat. Off. . |
| 292084 | 11/1988 | European Pat. Off. . |
| 2197898 | 6/1988 | United Kingdom . |

*Primary Examiner*—Hoang C. Dang
*Attorney, Agent, or Firm*—James E. Bradley

[57] ABSTRACT

A subsea well assembly has a tubular inner housing that locates within a tubular outer housing. A locking element carried by the inner member is biased outward for engaging a groove provided in the bore of the outer member. The inner member has a metal compression shoulder that has a skirt portion that engages the rim of the outer member. A recess located in the load ring provides slight resiliency to the skirt portion of the load ring. This resiliency allows the load ring to deflect elastically during bending forces exerted on the inner member. The slight deflection of the skirt portion of the load ring results in the locking element moving deeper into the groove to preload the connection.

11 Claims, 3 Drawing Sheets

SELF PRELOADING CONNECTION FOR A SUBSEA WELL ASSEMBLY

BACKGROUND OF THE INVENTION

1. Field of the Invention

This invention relates in general to subsea well assemblies, and in particular to a connector for connecting a high pressure wellhead housing into a low pressure wellhead housing.

2. Description of the Prior Art

In one type of offshore well drilling, a low pressure wellhead housing will be installed on the sea floor. The low pressure wellhead housing is a large tubular member, having conductor pipe that extends into an initial portion of the well.

A high pressure wellhead housing lands in and secures to the low pressure wellhead housing. The high pressure wellhead housing is a tubular member with casing located on the lower end that extends to a deeper depth in the well than the conductor pipe. A string of riser will connect the high pressure wellhead housing to surface drilling or production equipment.

Waves and currents will cause a bending force on the string of riser. This force transmits down to the high pressure wellhead housing. If the high pressure is allowed to move back and forth, this rocking action can eventually fatigue the metal. The point where the high pressure wellhead housing connects to the casing will normally experience the greatest fatigue and may result in a failure.

There are various proposals for tightly locking the high pressure housing to the low pressure housing so as to prevent relative rocking movement between the high pressure wellhead housing and the low pressure wellhead housing. If the high pressure housing is not movable relative to the low pressure housing, the strength of the low pressure housing will assist in preventing rocking movement of the high pressure housing, thereby reducing fatigue. These proposals generally involve wedge members which tightly wedge the high pressure housing into the low pressure housing.

Also, the high pressure housing will be latched by a connector into the low pressure housing so as to prevent any upward force due to loads from the riser or blowout preventer stack. These latch connection members also will fatigue due to bending forces of the riser.

SUMMARY OF THE INVENTION

In this invention, an annular groove is formed in the interior of the outer member or low pressure housing. This groove has a conical downward facing shoulder. The high pressure housing or inner member has a biased locking element carried by it that will move from a contracted position outward into engagement with the groove.

A compression load ring is rigidly mounted to the inner member and extends outward. A downward facing annular recess is formed in the load ring. The recess defines a skirt which depends downward from the load ring into contact with the rim of the outer member. The recess is sufficiently large so as to cause elastic axial deflection of a portion of the load ring under compressive load.

The deflection of the load ring allows slight downward movement of the inner member. This results in slight downward movement of the locking element relative to the groove. The locking element works its way more deeply into the groove during the deflection. This results in a connection between the inner member and the outer member that preloads with compressive force and does not allow any upward movement under tension.

DETAILED DESCRIPTION OF THE INVENTION

Figure 1:
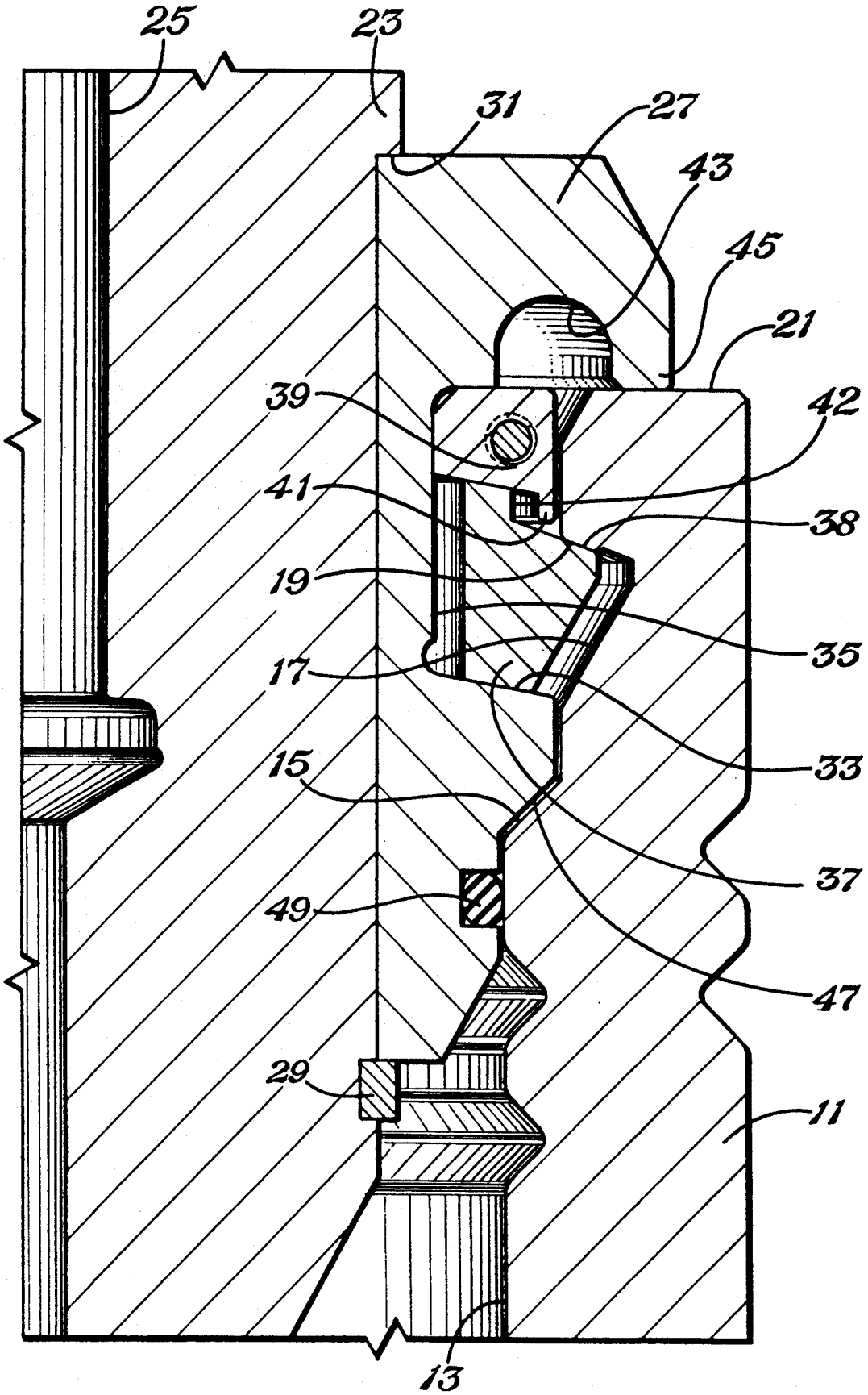
FIG. 1 is a vertical sectional view illustrating portions of a connector for connecting a high pressure wellhead housing into a low pressure wellhead housing, with the high pressure housing shown latched in place.

Referring to FIG. 1, outer housing 11 is a low pressure wellhead housing that will be located on a sea floor. Outer housing 11 is tubular, having an axial bore 13. Conductor pipe (not shown) will extend downward from outer housing 11 into an initial portion of the well.

In the embodiment shown, bore 13 has a lower shoulder 15 that is conical and extends upward. A groove 17 is formed in bore 13 above lower shoulder 15. Groove 17 has a conical downward facing shoulder 19. Outer housing 11 has a rim 21 which locates on the upper end of outer housing 11 in a plane perpendicular to the longitudinal axis of bore 13.

Inner housing 23 is a tubular member that serves as a high pressure wellhead housing for a subsea well assembly. Inner housing 23 has casing (not shown) secured to its lower end which extends to a greater depth in the well than the conductor pipe connected with outer housing 11. Inner housing 23 is also tubular, having a bore 25.

A steel load shoulder or load ring 27 mounts rigidly to inner housing 23. Load ring 27 is retained on its lower end by a retaining ring 29 and may be shrunk fit to housing 23. A downward facing shoulder 31 on the exterior of inner housing 23 engages the upper side of load ring 27, preventing any axial movement of load ring 27 relative to inner housing 23.

Load ring 27 has an upward facing shoulder 33 that is tapered or slightly conical. Upward facing shoulder 33 defines a locking recess 35 that faces radially outward. A locking ring 37 is carried in locking recess 35. Locking ring 37 is biased outward and is preferably a resilient metal split ring. The split (not shown) and the inherent resiliency serve as a bias means, for urging locking ring 37 outward, and also to allow it to contract back inward into locking recess 35. Locking ring 37 has a conical upward facing shoulder 38 on its upper side that engages the downward facing shoulder 19 of groove 17. The conical angle of shoulder 38 is close but slightly different from the conical angle of shoulder 19.

Figure 2:
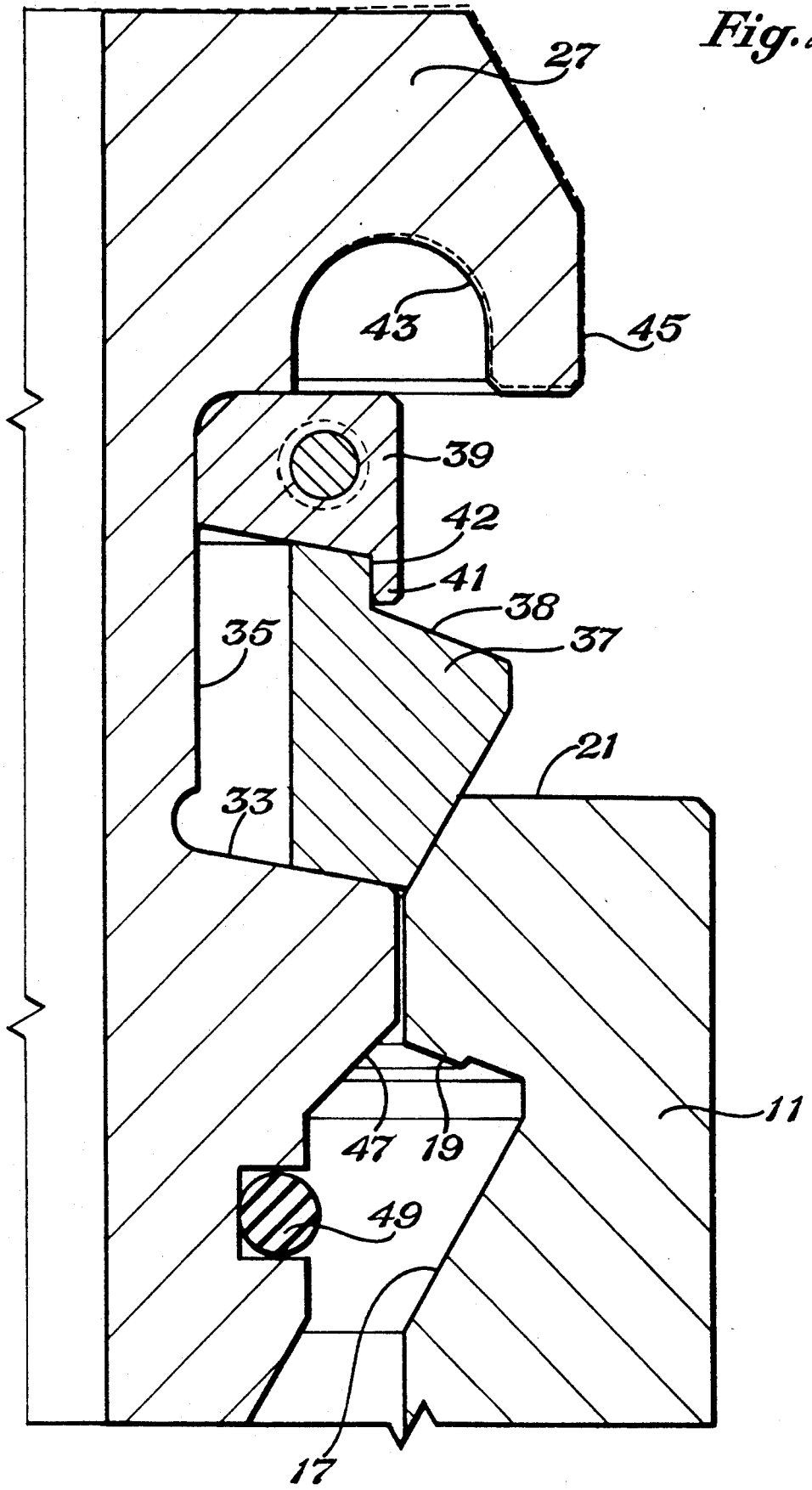
FIG. 2 is an enlarged partial sectional view of the connector of FIG. 1, showing the connector in a position that occurs as the high pressure housing is lowered into the low pressure housing.

A retaining ring 39 is secured in locking recess 35 above locking ring 37. Retaining ring 39 has a lip 41 on its outer periphery that extends downward to limit the outward movement of locking ring 37. Locking ring 37 has a neck 42 that will contact the lip 41 to limit the outward movement, as shown in FIG. 2. The lower side of retaining ring 39 is parallel to the upward facing shoulder 33 of recess 35. Retaining ring 39 will also limit any axial movement of locking ring 37 relative to load ring 27.

A load ring recess 43 extends upward from retaining ring 39. Load ring recess 43 is a large, curved downward facing annular recess. Load ring recess 43 defines a cylindrical wall or skirt 45 on the outer periphery of load ring 27. Skirt 45 extends downward and is positioned to engage rim 21. The dimension of load ring recess 43 and the thickness of the load ring 27 above the load ring recess 43 are selected so as to allow a slight amount of elastic deformation of a portion of load ring 27. The deflecting portion will be the portion of load ring 27 above the load ring recess 43.

The dotted lines in FIG. 2 illustrate deflection that occurs due to a large compressive load being applied to skirt 45. The solid lines indicate the position of skirt 45 that exists prior to compressive engagement of skirt 45 with rim 21. A compressive load on the inner housing 23 will transmit through the skirt 45 to the rim 21, whether it is due to weight of the riser or bending moment transmitted through the inner housing 23. If the load is sufficiently high, the outer portion of load ring 27 will deflect axially. The skirt 45 would move from the position shown by the solid lines to that shown by the dotted lines. The elastic deformation is not sufficiently high so as to create a permanent deformation in load ring 27.

Referring again to FIG. 1, in the embodiment shown, load ring 27 has on its lower portion a downward facing shoulder 47. Shoulder 47 locates slightly above lower shoulder 15 in outer housing 11. A clearance will exist between lower shoulder 15 and shoulder 47, and the shoulders 47, 15 are not of significance to this invention.

A seal ring 49 locates in a lower portion of load ring 27. Seal ring 49 is shown to be an elastomeric sealing ring for engaging a portion of bore 13 below groove 17.

Figure 3:
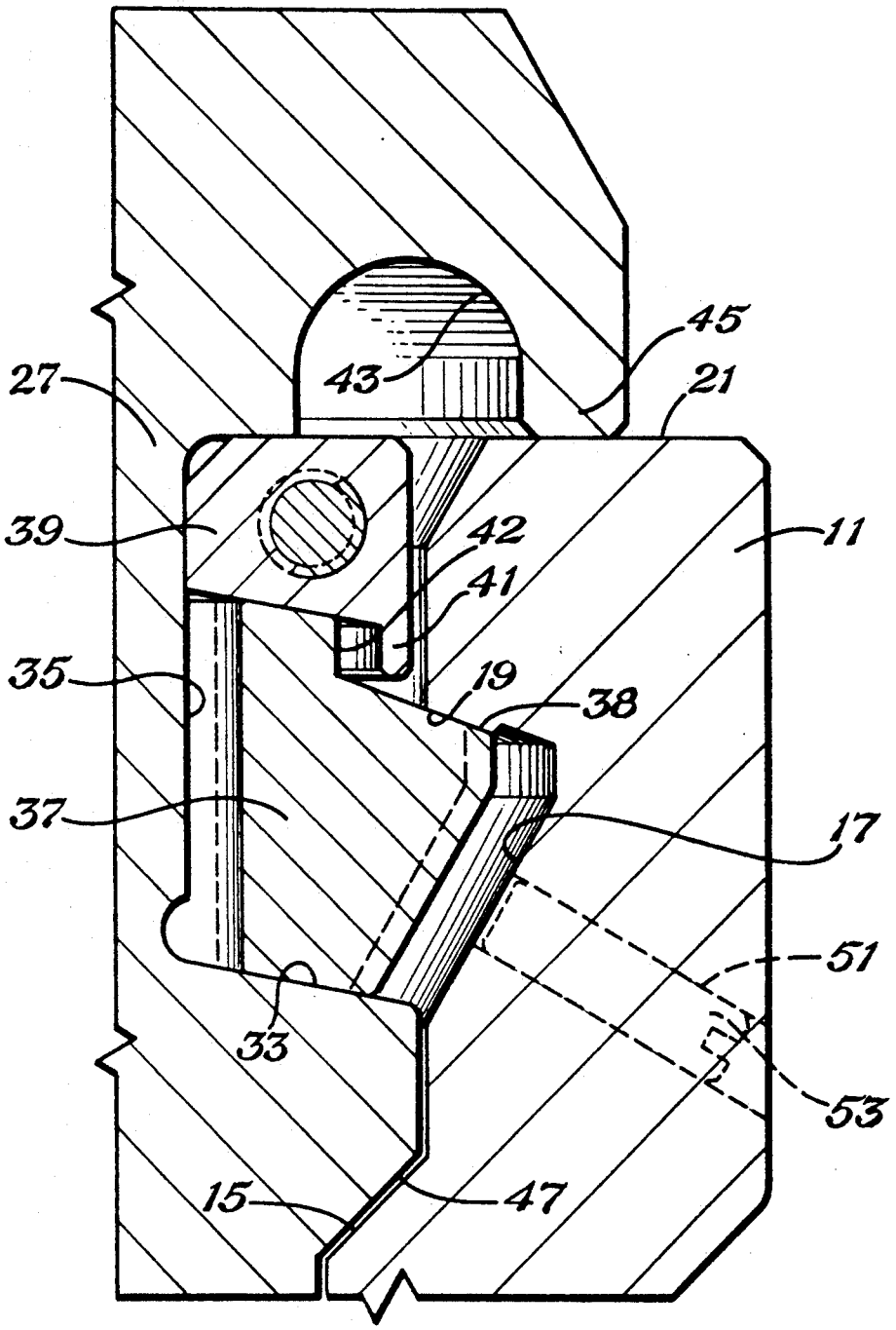
FIG. 3 is a partial enlarged sectional view of the connector of FIG. 1, also showing the connector in a latched position.

Referring to FIG. 3, means exist for forcing the locking ring 37 back to the contracted position in the event that the inner housing 23 is to be removed from the outer housing 11. In the embodiment shown, the means is schematically shown to be a plurality of threaded holes 51 (only one shown), each leading from the exterior of outer housing 11 to groove 17. The holes 51 are spaced circumferentially around the outer housing 11. A threaded screw 53 locates in each threaded hole 51. Screw 53, when rotated inward, will engage the locking ring 37 to push it back to the retracted position.

In operation, as the inner housing 23 is lowered into outer housing 11, the structure will appear as shown in FIG. 2. The locking ring 37 will be in an outer position. The load ring skirt 45 will be spaced above rim 21. The locking ring 37 will contact the inner diameter of rim 21, which then pushes the locking ring 37 inward to a contracted position.

The locking ring 37 will reach the groove 17, as shown in FIG. 3, and the resiliency of the locking ring 37 causes it to spring outward, as indicated by the dotted lines. At the same time, the skirt 45 will contact rim 21. Compressive load due to the weight of the blowout preventer stack or bending from the riser on the inner housing 23 will transmit through the load ring skirt 45 to the outer housing 11. Any upward or tension load due to internal pressure in inner housing 23 will transmit through the recess shoulder 33, locking ring 37, and to the groove shoulder 19.

During drilling, wave action on the riser will cause bending forces on the inner housing 23. These bending forces create compressive loads on the load ring skirt 45. Because of the bending force, the compressive load may not be uniform all the way around the skirt 45. The compressive load, if sufficiently high, will cause elastic deformation of the outer portion of load ring 27. The portion of load ring 27 above recess 43 will bend slightly as indicated by the dotted lines in FIG. 2.

This deflection results in a slight downward movement of the inner housing 23 relative to the outer housing 11. The locking ring 37 moves downward slightly. The bias force of the locking ring 37 causes it to move farther outward, deeper into groove 17 during this slight downward movement. Because the bending force due to wave action is not constant, there will be intervals between bending forces in which the compressive load decreases. Nevertheless, because of the taper and the bias of locking ring 37, it will not move back to a more retracted position. Rather, it will preload and make the connection tighter. The force exerted by the skirt 45 on the rim 21 increases each time a compressive force causes the retaining ring 39 to move deeper into the groove 17.

To remove the inner housing 23 from outer housing 11, a diver or remote operated vehicle will rotate screw 53 inward to push the locking ring 37 back to a retracted position. Once locking ring 37 clears the groove 17, the operator can pull the inner housing 23 upward from the outer housing 11.

The invention has significant advantages. The invention causes the connection between a high pressure housing and a low pressure housing to tightly increase with rocking movements due to wave action. This preload of the connection reduces the movement between the inner housing and the outer housing. This reduces fatigue.

While the invention has been shown in only one of its forms, it should be apparent to those skilled in the art that it is not so limited, but is susceptible to various changes without departing from the scope of the invention.

I claim:

1. In a subsea well assembly of the type having a tubular outer member having an upper rim, a tubular inner member which lands in the outer member, an improved means for securing the inner member to the outer member, comprising in combination:

an annular groove formed in the outer member, the groove having a tapered downward facing shoulder;

a locking element carried by the inner member for movement into the groove in engagement with the downward facing shoulder, the locking element being a split ring which is dimensioned with an outward bias which urges the locking element into the groove;

a metal compression load ring rigidly mounted to the inner member and extending therefrom for engaging the rim of the outer member when the inner member lands therein; and the load ring having a portion dimensioned to elastically, axially deflect under a selected compressive load, thereby moving the locking element downward relative to the groove and causing the outward bias of the locking element to move the locking element further outward to more deeply engage the downward facing shoulder to preload the connection between the inner and outer members.

2. The well assembly according to claim 1 wherein the load ring has an annular downward facing recess extending continuously around a lower side of the load ring, defining a skirt which depends downward from the load ring into contact with the rim of the outer member, the recess being sufficiently large so as to cause said elastic axial deflection of the load ring.

3. In a subsea well assembly of the type having a tubular outer member, a tubular inner member which lands in the outer member, an improved means for securing the inner member to the outer member, comprising in combination:

an annular groove formed in the outer member, the groove having a tapered downward facing shoulder;

an upward facing compression load shoulder located on the outer member and positioned above the downward facing shoulder;

a locking element carried by the inner member for movement into the groove, the locking element having a tapered upward facing shoulder for engaging the downward facing shoulder, the locking element being a resilient split ring that has a relaxed outer diameter greater than an inner diameter of the outer member directly above the groove, so that a natural outward bias of the locking element urges the locking element into the groove as the inner member lands in the outer member;

retaining means in engagement with the locking element for causing the locking element to move downward in unison with any downward movement of the inner member after the locking element is in engagement with the groove; and deflection means mounted to the inner member and extending therefrom for engaging the compression load shoulder of the outer member when the inner member lands therein and for allowing slight downward movement of the inner member and locking element relative to the outer member under compressive load to cause the upward facing shoulder of the locking element to more tightly engage the downward facing shoulder, thereby reducing slack between the inner and outer members as the inner member is alternatively cycled from compression to tension loading due to bending forces.

4. In a subsea well assembly of the type having a tubular outer member having an upper rim, a tubular inner member which lands in the outer member, an improved means for securing the inner member to the outer member, comprising in combination:

an annular groove formed in the interior of the outer member, the groove having a tapered downward facing shoulder;

a locking element carried by the inner member and biased outward for movement into the groove in engagement with the downward facing shoulder, the locking element being a resilient split ring that has a relaxed outer diameter greater than an inner diameter of the outer member directly above the groove, so that a natural outward bias of the locking element urges the locking element into the groove as the inner member lands in the outer member;

retaining means in engagement with the locking element for causing the locking element to move downward in unison with any downward movement of the inner member after the locking element is in engagement with the groove;

a metal compression load ring rigidly mounted to the inner member and extending outward therefrom for engaging the rim of the outer member when the inner member lands therein; and recess means for causing a portion of the load ring to elastically, axially deflect under a selected compressive load, and for moving the locking element downward along with the inner member relative to the groove and causing the locking element to more deeply engage the downward facing shoulder to preload the connection between the inner and outer members.

5. The well assembly according to claim 4, wherein the recess means comprises an annular recess formed in the load ring and extending continuously around a lower side of the load ring, defining a skirt which depends downward from the load ring into contact with the rim of the outer member, the recess being sufficiently large so as to cause said elastic axial deflection of the load ring, the skirt being an annular member having a lower end which contacts the rim, and an interior wall extending upward from the lower end and defined by the recess.

6. The well assembly according to claim 4 wherein the locking element is carried by the load ring below the recess means, and wherein the recess means comprises an annular recess formed in the load ring, the recess being generally arcuate in transverse cross section.

7. In a subsea well assembly of the type having a tubular outer member having an upper rim, a tubular inner member which lands in the outer member, an improved means for securing the inner member to the outer member, comprising in combination:

an annular groove formed in the interior of the outer member, the groove having a tapered downward facing shoulder;

a locking element carried by the inner member and having a natural outward bias for movement into the groove in engagement with the downward facing shoulder;

a metal compression load ring rigidly mounted to the inner member and extending outward therefrom for engaging the rim of the outer member when the inner member lands therein;

recess means for causing a portion of the load ring to elastically, axially deflect under a selected compressive load, thereby moving the locking element downward relative to the groove and causing the natural outward bias of the locking element to move the locking element further outward to more deeply engage the downward facing shoulder to preload the connection between the inner and outer members; and wherein the locking element is a split resilient ring.

8. In a subsea well assembly comprising in combination:

a tubular outer member having an upper rim;

an annular groove formed in the interior of the outer member, the groove having a conical downward facing shoulder;

a tubular inner member which lands in the outer member;

a locking element carried by the inner member and biased outward for movement into the groove in engagement with the downward facing shoulder, the locking element being a resilient split ring that has a relaxed outer diameter greater than an inner diameter of the outer member directly above the groove, so that a natural outward bias of the locking element urges the locking element into the groove as the inner member lands in the outer member;

a metal compression load ring rigidly mounted to the inner member and extending outward therefrom; and a cylindrical skirt which depends downward from the load ring into contact with the rim of the outer member, the load ring and skirt being dimensioned so as to cause elastic axial deflection of a portion of the load ring under a selected compressive load, thereby moving the inner member downward relative to the outer member and moving the locking element downward relative to the groove, causing the locking element to more deeply engage the downward facing shoulder.

9. The well assembly according to claim 8 wherein the skirt has a lower end which contacts the rim, and an interior wall extending upward from the lower end.

10. In a subsea well assembly comprising in combination:

a tubular outer member having an upper rim;

an annular groove formed in the interior of the outer member, the groove having a conical downward facing shoulder;

a tubular inner member which lands in the outer member;

a locking element carried by the inner member and biased outward for movement into the groove in engagement with the downward facing shoulder;

a metal compression load ring rigidly mounted to the inner member and extending outward therefrom;

a cylindrical skirt which depends downward from the load ring into contact with the rim of the outer member, the load ring and skirt being dimensioned so as to cause elastic axial deflection of a portion of the load ring under a selected compressive load, thereby moving the inner member downward relative to the outer member and moving the locking element downward relative to the groove, causing the locking element to more deeply engage the downward facing shoulder; and a conical upward facing shoulder formed on the load ring below the recess, the locking element comprising a split resilient ring carried on the upward facing shoulder.

11. In a subsea well assembly comprising in combination:

a tubular outer member having an upper rim;

an annular groove formed in the interior of the outer member, the groove having a conical downward facing shoulder;

a tubular inner member which lands in the outer member;

a locking element carried by the inner member and biased outward for movement into the groove in engagement with the downward facing shoulder;

a metal compression load ring rigidly mounted to the inner member and extending outward therefrom;

a cylindrical skirt which depends downward from the load ring into contact with the rim of the outer member, the load ring and skirt being dimensioned so as to cause elastic axial deflection of a portion of the load ring under a selected compressive load, thereby moving the inner member downward relative to the outer member and moving the locking element downward relative to the groove, causing the locking element to more deeply engage the downward facing shoulder;

a threaded hole extending through the outer member from the groove to the exterior of the outer member; and a threaded member engaging the threaded hole for selectively advancing inward into contact with the locking element to retract the element from the groove to remove the inner member from the outer member.

* * * * *